United States Patent [19]

Argon

[11] Patent Number: 4,787,290

[45] Date of Patent: Nov. 29, 1988

[54] SUPPORT APPARATUS FOR A GRENADE THROWER TUBE

[75] Inventor: Gideon Argon, Tel-Aviv, Israel

[73] Assignee: Salgad International Ltd., Cayman Insel, Cayman Islands

[21] Appl. No.: 86,545

[22] Filed: Aug. 18, 1987

[30] Foreign Application Priority Data

Sep. 10, 1986 [DE] Fed. Rep. of Germany ..... 3630729

[51] Int. Cl.[4] ..... F41F 23/24

[52] U.S. Cl. ..... 89/37.05

[58] Field of Search ..... 89/37.02, 37.03, 37.05, 89/37.16, 1.35, 40.02, 40.06, 40.08

[56] References Cited

U.S. PATENT DOCUMENTS

| | | | |
|---|---|---|---|
| 2,046,518 | 7/1936 | Joyce | 89/37.05 |
| 2,208,015 | 7/1940 | Caulkins | 89/37.05 |
| 2,518,452 | 8/1950 | Davis, Jr. et al. | 89/37.05 |
| 3,112,674 | 12/1963 | Jasse | 89/37.05 |
| 3,782,243 | 1/1974 | Ziegler | 89/37.05 |
| 4,434,703 | 3/1984 | Fog et al. | 89/37.03 |

FOREIGN PATENT DOCUMENTS

| | | | |
|---|---|---|---|
| 70195 | 11/1941 | Czechoslovakia | 89/37.05 |
| 954977 | 4/1964 | United Kingdom | 89/37.05 |

*Primary Examiner*—Deborah L. Kyle
*Assistant Examiner*—Stephen Johnson
*Attorney, Agent, or Firm*—Neil F. Markva

[57] ABSTRACT

A support apparatus for a grenade thrower tube comprises a height adjustment assembly that raises and lowers the tube along a vertical axis and a sideways adjustment assembly that moves the tube back-and-forth in a direction transverse to the vertical axis. The novel combination with the support apparatus comprises an extension mechanism pivotally mounted to rotate about the vertical axis and a coupling device for rotatably connecting the sideways adjacent assembly on the extension mechanism at a location laterally spaced from the vertical axis. In a specific embodiment, the coupling device includes a locking mechanism which fixes the sideways adjustment assembly at a selected rotational position with respect to the extension mechanism. The locking mechanism has an automatically actuating capacity to lock the rotational position of the sideways adjustment assembly at a preselected location. The combination of the invention allows the adjusting of the grenade thrower tube in the sideways range to be extended considerably without having to move the bipod or tripod stand of the support apparatus.

17 Claims, 4 Drawing Sheets

SUPPORT APPARATUS FOR A GRENADE THROWER TUBE

FIELD OF THE INVENTION

This invention relates to a support apparatus for a grenade thrower tube comprising a bipod or tripod stand and a base plate flexibly receiving the tube end. More particularly, the invention relates a support apparatus for a grenade thrower having a stand carrying a height adjusting assembly and a tube holder disposed on a sideways adjusting assembly.

BACKGROUND OF THE INVENTION

A known support apparatus includes a height adjusting device located on a bipod or tripod stand with a sideways adjusting assembly which carries a holding device for the grenade thrower tube. Such known support apparatus is capable of correcting the elevation of the mounted grenade thrower tube and producing a sideways tube adjustment with respect to the mounted bipod or tripod stand. This enables the grenade thrower tube to be oriented to the desired target.

The adjusting ranges for the known support apparatus are relatively small. Therefore, the bipod or tripod stand and base plate on which the throwing tube is pivotally carried must be mounted to position the throwing tube in at least an approximately desired target direction. Great operator skill and experience is required to select the location for the support apparatus for effecting the exact orienting to the target, within the ranges for the grenade thrower given through the built-in height adjusting assembly and sideways adjusting assembly. When exact orientation is not achieved in the first instance, the bipod or tripod stand must necessarily be moved to start all over again. The required degree of displacement cannot always be met exactly. Thus, valuable minutes pass before the throwing tube can be adjusted to place the grenade thrower on target.

SUMMARY OF THE INVENTION

The primary object of the invention is to provide a support apparatus for a grenade thrower tube which allows a simple adjusting of the tube in a sideways range to be extended considerably without impairing the existing construction of the sideways adjusting mechanism.

Another object of the invention is to provide a support apparatus for a grenade thrower tube permitting a considerable extension for adjusting the tube in the sideways range without having any influence on existing construction of the sideways adjusting assembly.

The invention as described herein is directed to a support apparatus comprises a height adjustment assembly that raises and lowers the tube along a vertical axis and a sideways adjustment assembly that moves the tube back and forth in a direction transverse to the vertical axis. The apparatus includes a combination comprising extension means pivotally mounted to rotate about the vertical axis and coupling means for rotatably connecting the sideways adjustment assembly on the extension means at a location laterally spaced from the vertical axis. The invention is distinctive in that the combination extends the sideways adjusting range and is arranged between the height adjusting assembly and the sideways adjusting assembly.

In a particular feature of the invention, the combination has an extension arm with one end rotatably mounted on a vertical journal of the height adjusting assembly. The other end of the arm pivotally carries a cog member of the sideways adjusting assembly. The extension arm is rotatable around the longitudinal axis of the vertical journal for the height adjusting assembly. The sideways adjusting assembly carried by the cog member pivots around its own axis of rotation. With the combination disposed in a central position, the sideways adjusting assembly adjusts the grenade thrower range without any impairment by the combination of the invention. However, if the extension arm is rotated or swung to the left or right, the adjusting range of the grenade thrower is extended without the bipod or tripod stand having to be displaced.

According to another feature of the invention, the coupling means for rotatably connecting the sideways adjusting assembly include means for automatically locking the cog member and extension arm in various angle settings with respect to each other. The locking mechanism is actuated to automatically fix rotational cog positions in the extension arm.

Another feature of the invention is a locking mechanism comprising a snap mechanism. A coupling member stands under spring pressure and includes locking cams effective to correspondingly act with complementary recesses formed in the extension arm. The coupling member includes pin elements or bolts extending from a base portion toward the cog member with the longitudinal axes of the coupling member and cog member being parallel with respect to each other and, in a specific embodiment, coextensive.

The pin elements include the locking cams and extend in a direction parallel to the longitudinal axes of the coupling member and cog member. Any number of locking positions can be provided by varying the design of the coupling member with respect to the number of pin elements on it. In a specific embodiment, there are three locking positions; namely, central, right and left positions.

In the central position setting, the combination connected between the vertical adjusting assembly and the sideways adjusting assembly has no influence on the sideways range of the grenade thrower. On moving the combination to a predetermined left or right position, the adjusting range of the grenade thrower can be extended substantially in a sideways direction without the whole mounting of the stand and base plate having to be changed.

The coupling mechanism may include buffer means for limiting the pivoting of the cog member within a defined degree of rotation. The coupling member has a handle on one side of a base portion and a centrally arranged pin with an outer head portion extending in a direction toward the sideways adjustment assembly. Spring means disposed between the head portion and abutment means fixably disposed on the cog member to biassingly urge the coupling member toward the sideways adjustment assembly rotatably mounted at the spaced location.

The sideways adjusting range is extended, without the sealed sideways adjusting assembly having to forfeit its seal. The combination does not influence the weight of the bipod or tripod stand. The new combination can be built-in as an addition without impairing the construction of the prior art support apparatus. Only slight changes to the connection places of the combination arise. The combination of the invention is simple to construct and easily maintained.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
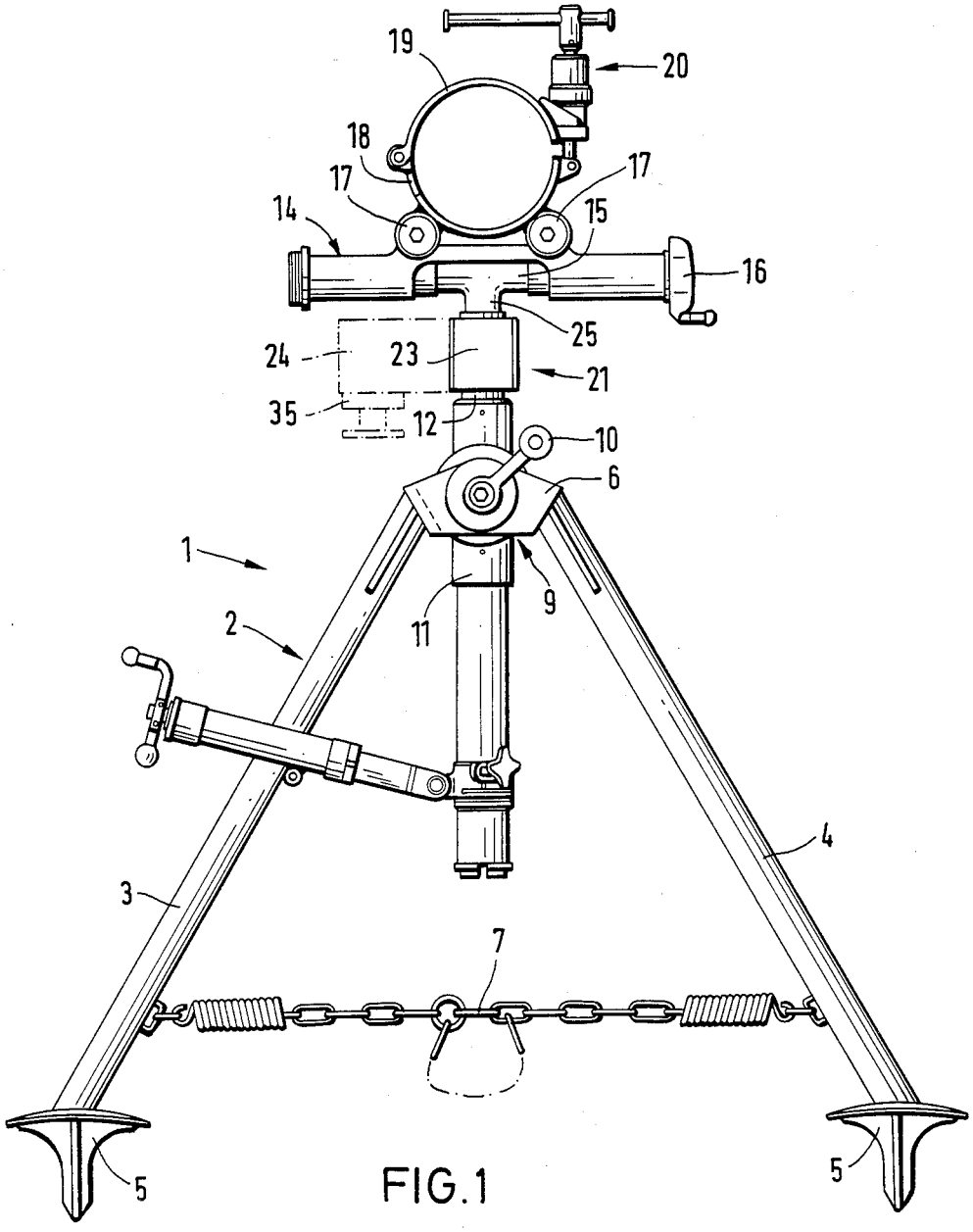
FIG. 1 is a front elevational diagrammatic view of a support assembly for a grenade throwing tube according to the invention.

The support apparatus, generally designated 1, comprises a bipod stand, generally designated 2, having legs 3 and 4 with base brackets 5 and a central plate 6. An elastic spring tension 7 secures legs 3 and 4 in a selected straddle position. Bipod stand 2 includes a height adjusting apparatus 9 having a hand crank 10 for operation thereof. A toothed gearing (not shown) is located in the housing of apparatus 9 for vertically displacing sleeve 12 carried in the housing buffing 11. The upper portion of sleeve 12 constitutes a vertical journal for receiving the grenade thrower tube holding assembly 14.

Holding assembly 14 contains a sideways adjusting apparatus 15 having crank 16 to effect to-and-fro sideways movement with respect to the central axis of bipod stand 2. Height adjustment is effected by crank 10. The range of the displacement path of the sideways adjusting apparatus 15 is limited for weight reasons.

A recoil brake cylinder 17 and carrier ring 18 are firmly linked to holding assembly 14 to receive the grenade throwing tube. Carrier ring 18 carries a clamp strap 19 which engages around a grenade throwing tube inserted into carrier ring 18. Clamping device, generally designated 20, tightens clamp strap 19 around the grenade throwing tube and flexibly engages into a base plate resting on a base in a known manner.

Adjustment extension combination 21 is arranged between height adjusting apparatus 9 and holding assembly 14 to substantially extend the sideways adjusting range of the grenade throwing tube. Adjustment extension combination 21 includes an extension arm 22 having one end 23 resting on vertical journal 12 of the height adjusting assembly 9 thereby defining a first vertical axis. The other end 24 of extension arm 22 pivotally carries a cog member 25 of holding assembly 14 thereby defining a second vertical axis. The extension arm end 23 carries a screw bush 27 screwed into the end of sleeve 12 by screw thread 28 and stops with collar 29 on a shoulder 30 of extension arm end 23. The end of sleeve 12 is linked to extension arm 22 through transverse pin 31 and thereby secured against turning.

Figure 2:
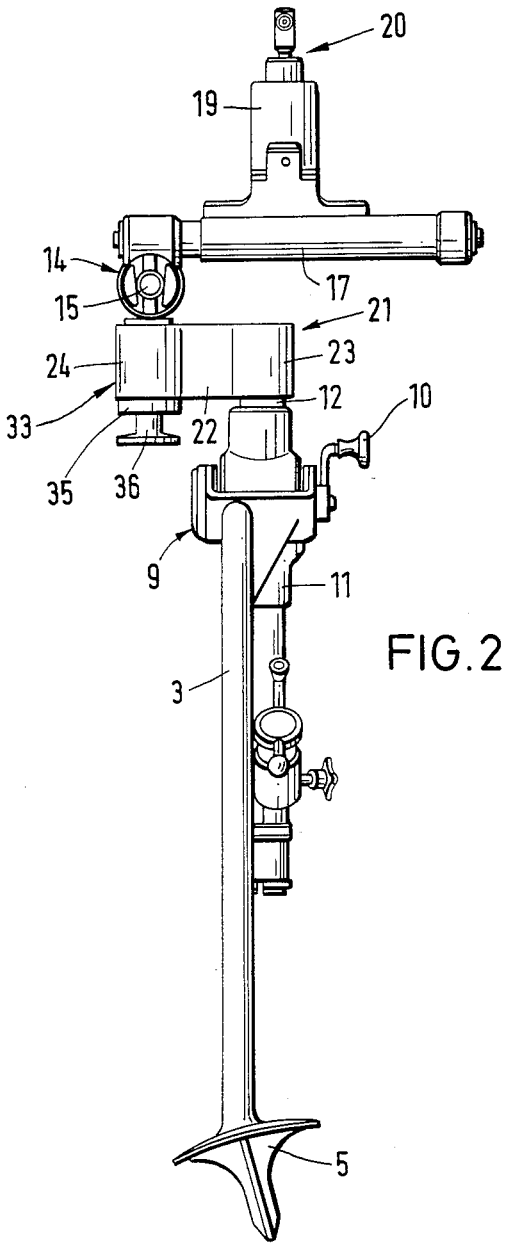
FIG. 2 is a side elevational diagrammatic view of the support assembly of FIG. 1.
Figure 3:
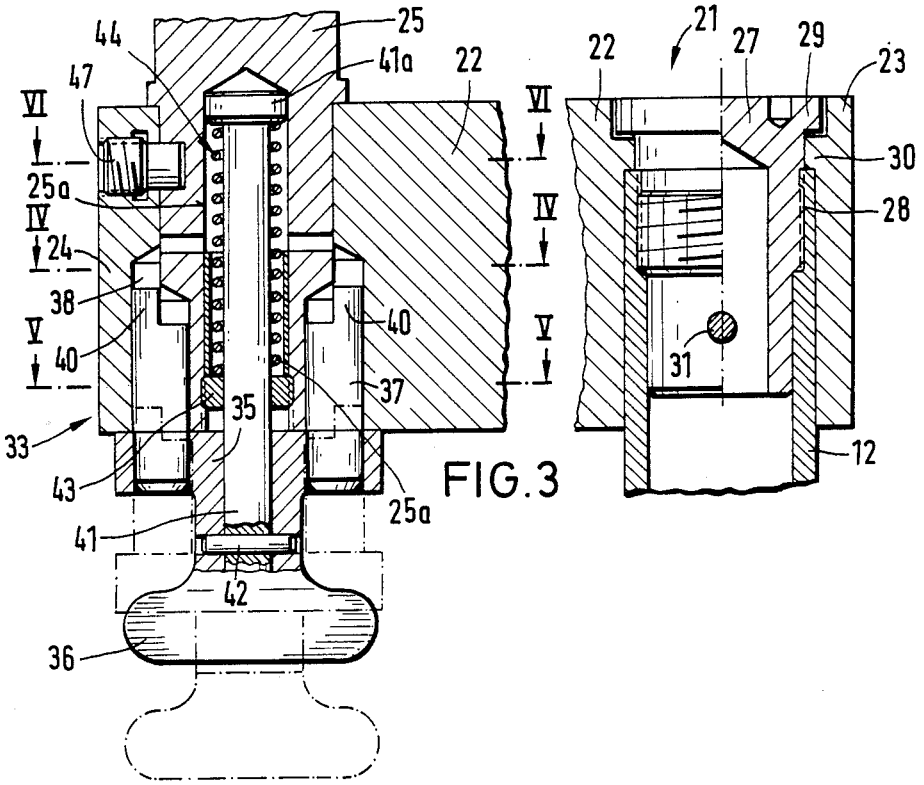
FIG. 3 is a fragmentary sectional view of an apparatus for extending the sideways adjusting range for the support assembly of FIG. 1.
Figure 4:
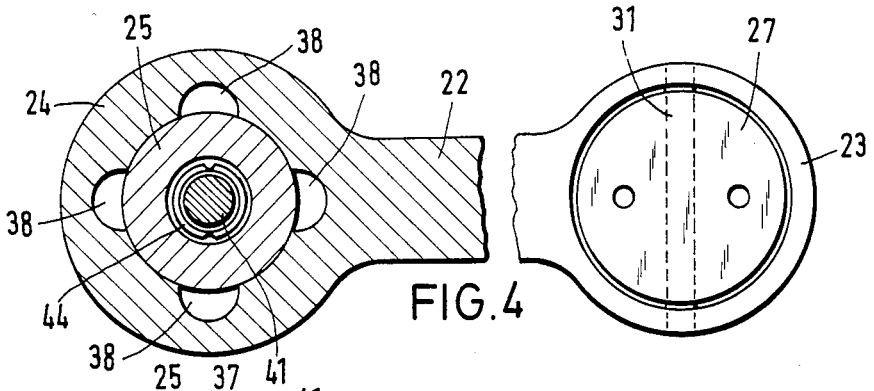
FIG. 4 is a sectional view along line IV—IV of the apparatus of FIG. 3.
Figure 5:
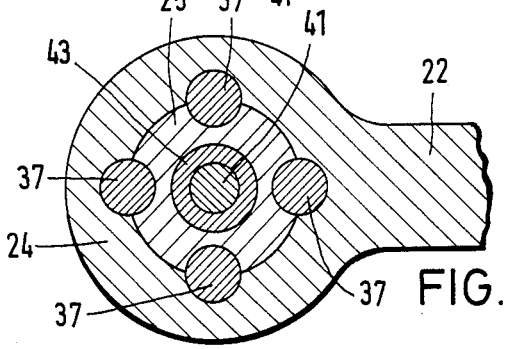
FIG. 5 is a sectional view along line V—V of the apparatus of FIG. 3.
Figure 6:
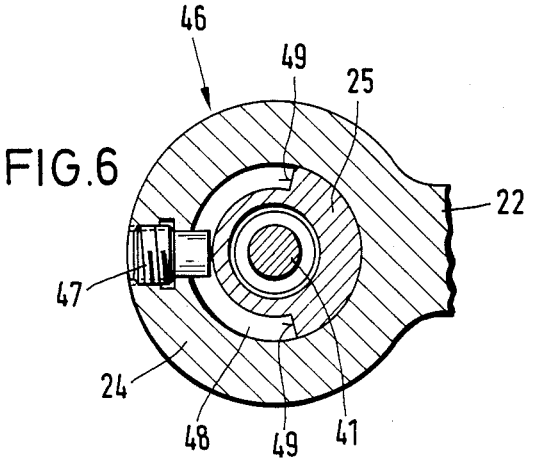
FIG. 6 is a sectional view along line VI—VI of the apparatus of FIG. 3.
Figure 7:
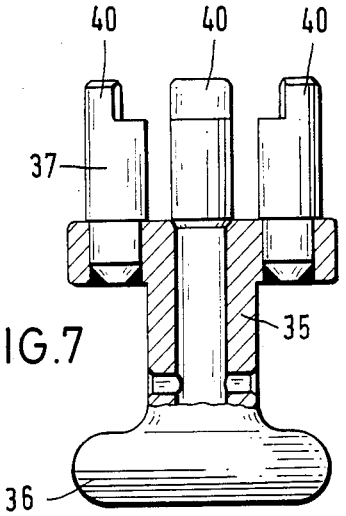
FIG. 7 is a diagrammatic elevational view, partly in section, of the sideways extending apparatus of the invention.
Figure 8:
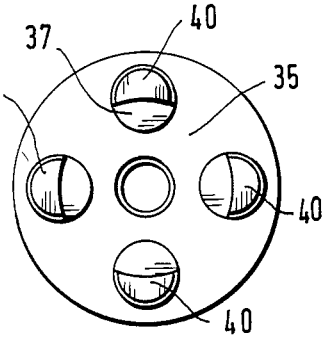
FIG. 8 is a top plan view of the extending apparatus shown in FIG. 7.

Coupling mechanism, generally designated 33 in FIG. 2, effectuates an automatic locking of cog member 25 to extension arm end 24 of holding assembly 14. Coupling member 35 has a handle 36 and locking cams distributed around cog member 25 to engage correspondingly designed recesses 38 on extension arm end 24. Locking cams 37 constitute bolts on coupling member 35 running axis-parallel and possess projections 40 extending in an axial direction.

Projections 40 have a semi-circular cross-section and fit into recesses 38 which also have a semi-circular cross-section. A transverse pin 42 secures a centrally arranged pin 41 to coupling member 35. Pin 41 includes a head piece **41*a* at an end opposite the transverse pin 42. An abutment ring 43 is screwed into bore 25*a* around pin 41**.

A spring 44 disposed between the head piece **41*a* and abutment ring 43 biassingly urges coupling member 35 toward cog member 25. With this configuration, locking bolts 37 with projections 40 are latched into corresponding recesses 38 of extension arm end 24 locking the rotational position coupling mechanism. Coupling member 35** is thus movable between a locking condition and a released condition.

A buffer assembly 46 limits the pivoting of cog member 25 within extension arm end 24. Buffer assembly 46 includes a bolt 47 screwed into extension arm end 24 and has an end extending into an annular groove 48 having buffer surfaces 49. Thus, the relative movement between cog member 25 and extension arm end 24 is limited to a defined swing angle between the buffer surfaces 49. In this specific embodiment, the amount of rotational pivoting is limited to 180°.

The combination of locking cams 37 and recesses 38 define three locking positions; namely, a central position, an extreme left position and an extreme right position. In the central position, extension arm 22 is located in the central plane of bipod 2. Extension arm 22 can be swung around to the right or to the left around the longitudinal, vertical of axis of sleeve 12. The sideways adjusting assembly 21 is turned when extension arm 22 pivots around the bearing mechanism at the extension arm 23. In example of this embodiment, arm 22 can pivot 180° from the central position to the right or to the left.

Coupling 33 automatically locks the position of extension arm 22 in three fixed positions via the working of the combination of locking cams 37 and recesses 38 as described above. When the extension arm 22 is in the central position, sideways adjusting assembly 21 has no influence on the sideways adjusting range of the grenade thrower. However, when extension arm 22 is pivoted around the axis of sleeve 12 by 90° either to the left or to the right, the adjusting range of the grenade thrower is substantially extended without bipod 2 having to be displaced. Thus, the adjusting of the grenade throwing tube toward the target is substantially simplified and accelerated.

While the support apparatus for a grenade thrower tube has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. In a support apparatus for a grenade thrower tube wherein a height adjustment assembly raises and lowers the tube along a first vertical axis and a sideways adjustment assembly moves the tube back-and-forth in a direction transverse to the first vertical axis, the combination comprising:

(a) transverse extension arm means pivotally mounted between the height adjustment assembly and the sideways adjustment assembly to rotate about said first vertical axis, and (b) coupling means pivotally connecting the sideways adjustment assembly to rotate about a second vertical axis on the transverse extension arm means at a location laterally spaced form said first vertical axis to rotatably carry the sideways adjustment assembly about said second vertical axis when the transverse extension arm means rotates about said first vertical axis.

2. The combination as defined in claim 1 wherein the coupling means includes means for locking the sideways adjustment assembly in a fixed rotational position with respect to the transverse extension arm means.

3. The combination as defined in claim 2 wherein said locking means includes means for automatically actuating the locking of the rotational position of the sideways adjustment assembly.

4. The combination as defined in claim 1 wherein said transverse extension arm means includes connecting means for securing the transverse extension arm means against pivoting around said first vertical axis.

5. The combination as defined in claim 1 wherein said height adjustment assembly includes a vertically disposed journal member at said first vertical axis, and said transverse extension arm means includes an extension arm pivotally connected to said journal member.

6. The combination as defined in claim 5 wherein said sideways adjustment assembly includes a cog member pivotally carried by the extension arm to rotate about said second vertical axis at said laterally spaced location.

7. The combination as defined in claim 6 wherein said coupling means includes means for locking the rotational position of the cog member with respect to the extension arm.

8. In a support apparatus for a grenade thrower tube wherein a height adjustment assembly raises and lowers the tube along a vertical axis and a sideways adjustment assembly moves the tube back-and-forth in a direction transverse to the vertical axis, the combination comprising:

(a) transverse extension arm means pivotally mounted between the height adjustment assembly and the sideways adjustment assembly to rotate about said vertical axis, (b) coupling means for rotatably connected the sideways adjustment assembly on the transverse extension arm means at a location laterally spaced from said vertically axis to rotatably carry the sideways adjustment assembly when the transverse extension arm means rotates about said vertical axis, (c) said transverse extension arm means including connecting means for securing the transverse extension arm means against pivoting around said vertical axis, (d) said height adjustment assembly including a vertically disposed journal member, (e) said transverse extension arm means including an extension arm member, and (f) said connecting means including a screw bush and transverse pin to link the extension arm member to the journal member.

9. In a support apparatus for a grenade thrower tube wherein a height adjustment assembly raises and lowers the tube along a vertical axis and a sideways adjustment assembly moves the tube back-and-forth in a direction transverse to the vertical axis, the combination comprising:

(a) extension means pivotally mounted to rotate about said vertical axis, (b) coupling means for rotatably connecting the sideways adjustment assembly on the extension means at a location laterally spaced from said vertical axis, (c) said extension means is disposed between the height adjustment assembly and the sideways adjustment assembly, (d) said height adjustment assembly including a vertically disposed journal member, (e) said extension means including an extension arm pivotally connected to said journal member, (f) said sideways adjustment assembly including a cog member pivotally carried by the extension arm at said laterally spaced location, (g) said coupling means including means for locking the rotational position of the cog member with respect to the extension arm, (h) said locking means comprising a snap mechanism including means for biasing a coupling member having locking cams effective to correspondingly act with complementary recesses formed in the extension arm.

10. The combination as defined in claim 9 wherein said coupling member includes pin elements extending from a base portion toward the cog member with the longitudinal axis of the coupling member and the cog member being parallel with respect to each other.

11. The combination as defined in claim 10 wherein said pin elements contain said locking cams and extend in a direction parallel to the longitudinal axes of the cog member and coupling member.

12. The combination as defined in claim 11 wherein said coupling means includes buffer means for limiting the pivoting of the cog member within a defined degree of rotation.

13. In a support apparatus for a grenade thrower tube wherein a height adjustment assembly raises and lowers the tube along a vertical axis and a sideways adjustment assembly moves the tube back-and-forth in a direction transverse to the vertical axis, the combination comprising:

(a) extension means pivotally mounted to rotate about said vertical axis, (b) coupling means for rotatably connecting the sideways adjustment assembly on the extension means at a location laterally spaced from said vertical axis, (c) said coupling means including a coupling member having a handle on one side of a base portion and a centrally arranged pin with an outer head portion extending in a direction toward said sideways adjustment assembly, (d) spring means being disposed between said outer head portion and an abutment means fixedly disposed on a cog member of the sideway adjustment assembly rotatably mounted at said laterally spaced location.

14. The combination as defined in claim 13 wherein said coupling member includes pin elements extending from a base portion toward the cog member with the longitudinal axes of a coupling member and cog member being co-extensive.

15. The combination as defined in claim 14 wherein said pin elements include locking cams effective to correspondingly act with complementary recesses formed in the extension means.

16. The combination as defined in claim 15 wherein said pin elements extend in a direction parallel to the longitudinal axes of the coupling member and cog member and have outer end projection sections which include said locking

17. The combination as defined in claim 16 wherein said outer end projection sections have a semi-circular cross-section.

* * * * *